US006477234B2

(12) United States Patent
Harding et al.

(10) Patent No.: US 6,477,234 B2
(45) Date of Patent: Nov. 5, 2002

(54) X-RAY SOURCE HAVING A LIQUID METAL TARGET

(75) Inventors: Geoffrey Harding, Hamburg (DE); Bernd Ulmer, Stuttgart (DE); Bernd David, Huettblek (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/014,185

(22) Filed: Dec. 11, 2001

(65) Prior Publication Data

US 2002/0080919 A1 Jun. 27, 2002

(30) Foreign Application Priority Data

Dec. 16, 2000 (DE) ..... 100 62 928

(51) Int. Cl.[7] ..... H01J 35/12
(52) U.S. Cl. ..... 378/141
(58) Field of Search ..... 378/141, 143, 378/130

(56) References Cited

U.S. PATENT DOCUMENTS

| | | | | |
|---|---|---|---|---|
| 3,246,146 A | * | 4/1966 | Cohen et al. | 250/49.5 |
| 4,953,191 A | * | 8/1990 | Smither et al. | 378/143 |
| 5,052,034 A | * | 9/1991 | Schuster | 378/121 |
| 6,185,277 B1 | * | 2/2001 | Hardling | 378/143 |

* cited by examiner

*Primary Examiner*—Robert H. Kim
*Assistant Examiner*—Irakli Kiknadze
(74) *Attorney, Agent, or Firm*—John Vodopia

(57) ABSTRACT

The invention relates to an X-ray source that is provided with a liquid metal target and an electron source (3) for the emission of an electron beam (4) through a window (23) of a duct section (51) wherethrough the liquid metal target flows in the operating condition. The X-ray source is notably characterized in that the duct section (51) is formed by a first duct segment (10, 20) that includes the window (23) and wherethrough the liquid metal target flows, and by a second duct segment (30, 40) wherethrough a cooling medium flows and which is connected to the first duct segment in such a manner that the area in which the electron beam acts on the first duct segment is cooled.

9 Claims, 2 Drawing Sheets

X-RAY SOURCE HAVING A LIQUID METAL TARGET

Figure 1:
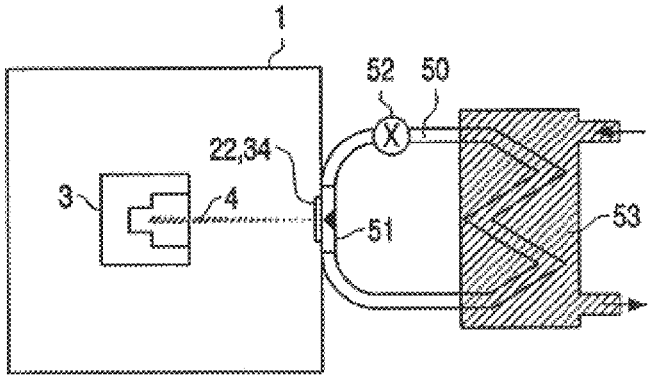
Figure 2A:
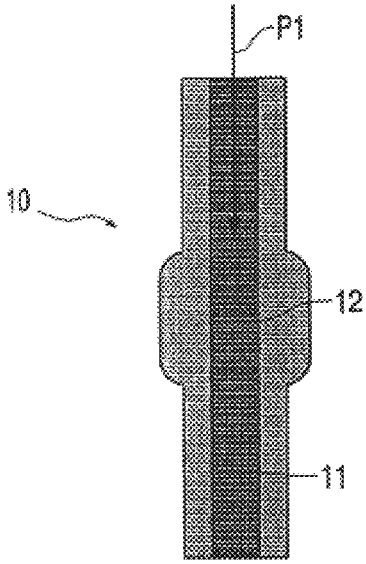
Figure 2B:
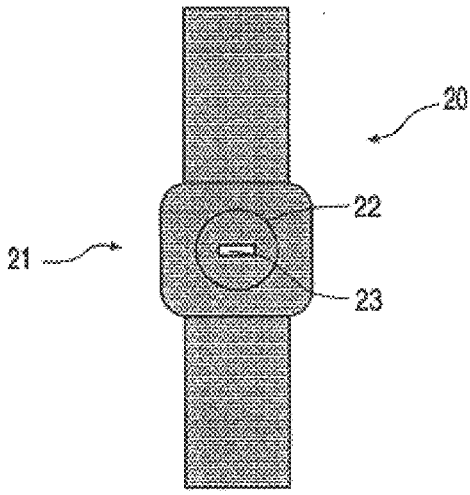
Figure 2C:
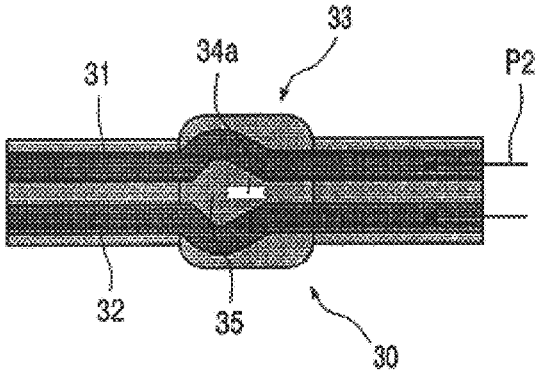
Figure 2D:
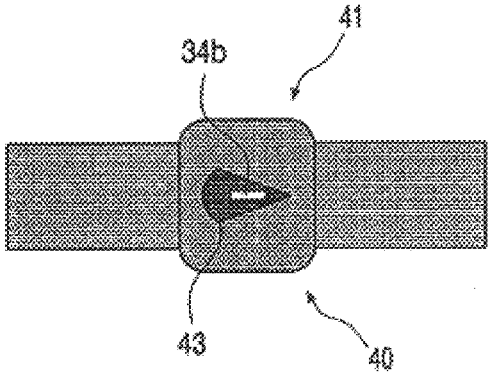

The invention relates to an X-ray source that includes a liquid metal target and an electron source for the emission of an electron beam in a window of a duct section wherethrough the liquid metal target flows in the operating condition, and also to an X-ray apparatus that is provided with such an X-ray source.

An X-ray source of this kind is known from DE 198 21 939.3. The window that is traversed by the electrons from the electron source so as to be incident on the liquid metal target is then cooled by a turbulent flow of the target. This type of cooling significantly enhances the continuous loadability of the X-ray source. A further increase of the loadability, however, is opposed by the fact that the window as well as the areas of the X-ray source that enclose the window, that is, the window frame, are subject to comparatively high thermal stresses. The origins of such stresses lie in the development of heat that is due notably to the direct incidence of electrons of high energy and the flow of the hot liquid metal underneath the window. Furthermore, the scattered electrons that exhibit only a small loss of energy also contribute to the development of heat.

This is particularly critical because the connection between the window and the window frame can withstand a limited maximum temperature only that is dependent on the bond technology used (for example, soldering, gluing).

Therefore, it is an object of the present invention to provide an X-ray source that has a liquid metal target and an electron source of the kind set forth and whose continuous loadability can be further increased.

This object is achieved by means of an X-ray source of the kind set forth which, as disclosed in claim 1, is characterized in that the duct section is formed by a first duct segment that includes the window and wherethrough the liquid metal target flows, as well as by a second duct segment wherethrough a cooling medium flows and which is connected to the first duct segment in such a manner that the area in which the electron beam acts on the first duct segment is cooled.

A particular advantage of this solution consists in the fact that the increased dissipation of heat enables a further increase of the loadability of the X-ray source, that is, notably in the case of applications where a high X-ray dose must be generated within a short period of time, for example, in CT apparatus with a high scanning rate.

The dependent claims relate to advantageous further embodiments of the invention.

The claims 2 to 5 disclose steps that realize a further improvement of the dissipation of heat in various manners. In the embodiments that are disclosed in the claims 6 and 7 the duct section is advantageously configured in such a manner that on the one hand an X-ray beam that propagates at a given spatial angle of aperture is not disturbed while on the other hand it is not necessary either to tolerate any influencing of the cooling.

Figure 3:
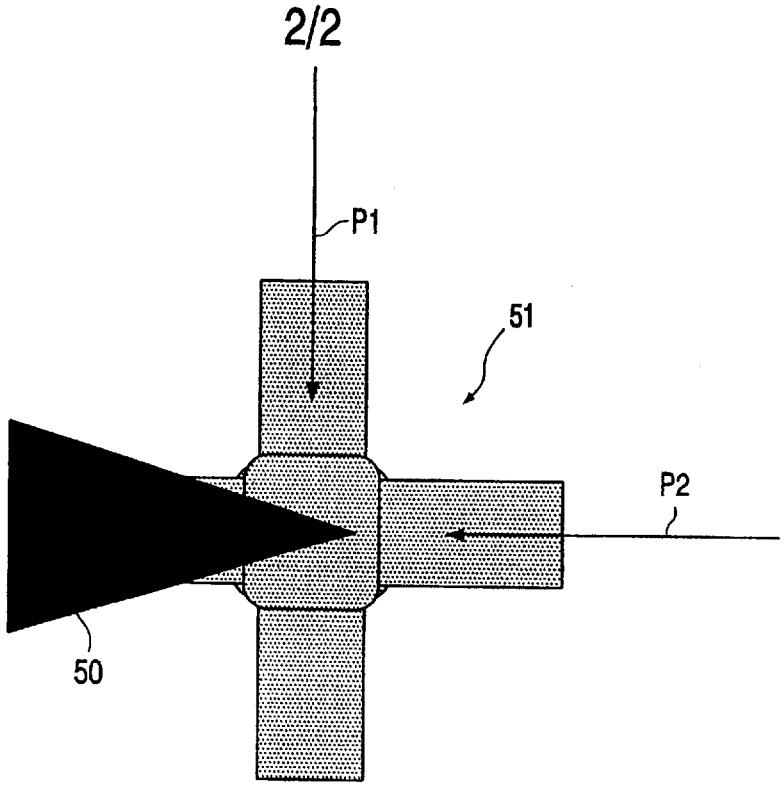
Figure 4:
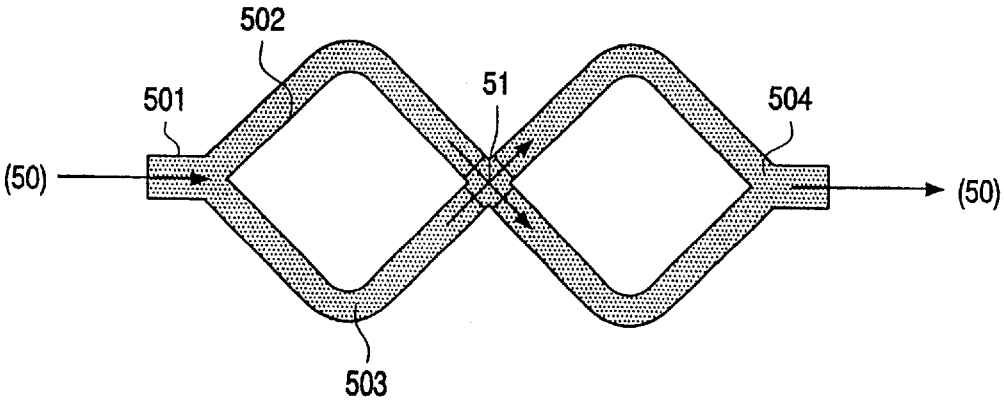

Further details, characteristics and advantages of the invention will become apparent from the following description of a preferred embodiment that is given with reference to the drawing. Therein:

FIGS. 1 is a diagrammatic representation of an X-ray source in accordance with the invention;

FIGS. 2*a*–2*d* shows various elements of a duct section in accordance with the invention;

FIG. 3 shows the duct section in accordance with the invention in the assembled condition, and FIG. 4 illustrates the feeding of the duct section in accordance with the invention.

FIG. 1 shows diagrammatically an X-ray source in which the target that is irradiated by means of electrons is formed by a metal that is liquid in the operating condition of the X-ray source. An electron source in the form of a cathode 3 that emits an electron beam 4 in the operating condition is arranged in a vacuum space within a tube envelope 1. The electron beam 4 is directed onto a duct section 51 of a system of ducts 50 and is incident, via a window 22, 34 that is essentially transparent to the electrons, on the liquid metal target that flows in the system of ducts 50, thus exciting X-rays. A pump 52 drives the liquid metal so as to circulate through the system of ducts 50 that also passes through a heat exchanger 53, so that the heat developed can be dissipated from the liquid metal via a cooling circuit.

The duct section 51 of the system of ducts 50 is shown in detail in the plan view of the FIGS. 2 and 3.

As is shown in FIG. 2, the duct section 51 consists of four elements 10, 20, 30, 40 which are shown in the sequence (a) to (d) and are arranged one over the other in this sequence; this means that on the first element 10 of FIG. 2(*a*) there is arranged the second element 20 of FIG. 2(*b*), and thereon the third element 30 in accordance with FIG. 2(*c*) and thereon finally the fourth element 40 as shown in FIG. 2(*d*). The elements are mounted on one another in the orientation that is shown in FIG. 2. The electron beam first enters the fourth element 40 from above in the direction perpendicular to the plane of drawing, subsequently traverses the third element 30 and the second element 20 and finally enters the first element 10.

It is also to be assumed that the electron beam forms a line-shaped focal point (strip focus) that extends from left to right in the FIG. 2. A strip focus of this kind has dimensions of, for example 1 mm×7 mm and is often used in X-ray sources in order to increase the irradiated surface area while the power density remains constant.

The first element 10 that is shown in FIG. 2(*a*) is made of a solid metal body, for example of steel or molybdenum, that has a length of, for example 100 mm, a width of 25 mm and a depth of 10 mm. In said metal body there is provided a first duct 11 wherethrough the liquid metal target, in which the X-rays are generated, flows in the operating condition of the assembled duct section, that is, in the direction indicated by the arrow P1. The depth of this first duct 11 is not constant, but decreases in a central region 12. The depth of the duct is smallest at the area of the central region in which the electron beam enters; for example, at this area it amounts to approximately 200 $\mu$m.

The second element 20 that is shown in FIG. 2(*b*) has a thickness of approximately 1 mm and otherwise has the same external dimensions as the first element 10. In a central region 21 there is provided an essentially circular insert 22 in which a first, essentially rectangular slit 23 is provided for the electron beam. The longitudinal direction of this slit extends perpendicularly to the flow direction of the liquid metal target, so that optimum dissipation of heat is achieved.

At its lower side (as shown in the drawing) the first slit 23 is sealed by means of a diamond layer of a thickness of approximately 1 $\mu$m; this layer is attached to the insert 22 by bonding or gluing or in another manner. The first slit thus forms a diamond window 23 that is transparent to electrons.

The second element 20 is attached to the first element 10 by means of screws or other fixing means (not shown) in such a manner that a first liquid-tight duct segment 10, 20 is formed wherethrough the liquid metal target can flow. Because of the reduced depth of the duct 11 in the central region 12, the flow of the target is accelerated at this area, notably at the diamond window, so that a turbulent flow is created. This turbulent flow provides a particularly effective dissipation of thermal energy from the window, because the turbulence arising mixes the liquid particularly thoroughly and quickly. This is advantageous notably in the temperature-critical area of the diamond window and its connection to the insert 22.

The first duct segment 10, 20 forms part of a primary liquid metal circuit that extends through the heat exchanger 53 (FIG. 1).

There is also provided a second duct segment 30, 40 that conducts a cooling medium and is mounted at an angle of approximately 90 degrees on the first duct segment 10, 20 as shown in the FIGS. 2(*c*), (*d*), so that it extends over the first slit 23 and in the longitudinal direction thereof.

The second duct segment includes a third element 30 which, in conformity with FIG. 2(*c*), consists of a metal body of, for example steel or molybdenum, that comprises a central region 33. In the central region 33 there is provided a second, essentially rectangular slit 34*a* which is oriented and formed in such a manner that it forms a continuation of the first slit 23 in the second element 20. In the metal body there are also recessed two ducts 31, 32 that extend in the longitudinal direction of the second slit 34*a* and parallel to one another, that is, outside the central region 33. In the central region 33 the ducts 31, 32 start to diverge from one another at the level of one end of the second slit 34*a* and start to extend parallel to one another again outside the central region, that is, at the level of the other end of the slit 34*a*. The ducts 31, 32 thus enclose a surface 35 that is shaped essentially as a segment of circle in the central region 33 in which the first slit 34*a* is situated.

The fourth element 40 has essentially the same external shape as the third element 30 and is mounted thereon by means of fixing means (not shown) so that the second, liquid-tight duct segment 30, 40 is formed. In a central region 41 of the fourth element 40 there is provided an essentially rectangular opening 34*b* of the second slit 34*a*. Moreover, in the external surface of the central region 41 there is formed a recess 43 that is shaped like a segment of circle that corresponds to the shape of the surface 35 that is enclosed by the ducts 31, 32 in the central region 33 of the third element 30. The recess is formed by removal of material by milling or in another manner.

In the assembled condition the second duct segment 30, 40 has a thickness of approximately 3 mm at the area of the recess 43 in which the strip focus of the electron beam is situated. Outside this area, that is, in an upstream direction and in a downstream direction as well as in a direction perpendicular thereto, the thickness may be larger, so that the ducts 31, 32 can be constructed so as to be wider or deeper and hence flow losses that are due to the viscosity of the cooling medium (secondary liquid) are reduced. The only limitation in this respect is imposed by the condition that the dimensions and the shape of the second duct segment should not interfere with the useful X-ray beam.

The second duct segment 30, 40 forms part of a secondary liquid circuit and serves to dissipate heat from the first duct segment, notably from the central region thereof in which the first slit 23 and hence the diamond window are situated. To this end, the second duct segment 30, 40 extends at an angle of 90 degrees relative to the first duct segment 10, 20. The preferred direction of flow of the primary liquid metal target through the first duct segment 10, 20 is denoted by the arrow P1 in FIG. 2(*a*) and the preferred direction of flow of the secondary liquid through the second duct segment 30, 40 is denoted by the arrows P2 in FIG. 2(*c*).

Three advantageous effects are achieved by means of this arrangement. On the one hand, the operating temperature of the primary liquid metal target is reduced. On the other hand, the temperature of the connection between the diamond window and the insert 22 is thus also reduced and finally the heat effect of the secondary electrons that are scattered from the primary electron beam so as to be incident in the vicinity of the focal point under the influence of the potential of the anode that is positive relative to the cathode, is also reduced.

These effects are assisted by the fact that the two ducts 31, 32 of the second duct segment 30, 40 extend parallel to the direction of the strip focus of the electron beam and to both sides of the slits. The flow in the secondary liquid circuit is thus conducted very close to the area of electron incidence.

Because of the diverging course of the ducts 31, 32 in the central region 33 of the second duct segment and the fact that the recess 43 in the central region 41 of the fourth element 40 is shaped as a segment of circle, the condition is satisfied that an X-ray beam must emanate from the opening 34*b* of the second slit 34*a* at a given spatial angle of aperture. In customary diagnostic X-ray tubes the angle between the plane of the anode and the X-ray that is nearest to the anode plane amounts to approximately 12 degrees. FIG. 3 shows these relationships for a duct section 51 that is composed of the first and the second duct segment; the preferred direction of flow of the primary liquid metal target again is denoted again by the arrow P1 and that of the secondary liquid is denoted again by the arrow P2.

The ducts 31, 32 diverge within the central region 33 of the third element 30 in such a manner that the X-ray beam 50 that emanates in conformity with FIG. 3 is not disturbed or attenuated by the ducts. The same applies to the proportioning of the recess 43 in the fourth element, so that the X-ray beam formed can propagate as a cone essentially without being disturbed when these two steps are taken.

In the representation in conformity with FIG. 4 the primary liquid circuit and the secondary liquid circuit can be fed in common with the same liquid metal via the duct 50 (FIG. 1), that is, by means of a pump 52; the duct 50 is then preferably routed through the heat exchanger 53.

More specifically, for this purpose there is provided a first duct branching piece 501 (Y piece) whereto the duct 50 is connected and wherefrom a primary duct 502 and a secondary duct 503 emanate. These ducts feed the duct section 51 and continue at the exits thereof until they are recombined by way of a second duct branching piece 504 (Y piece) and continue as a common duct 50. The primary duct 502 and the secondary duct 503 are routed in such a manner that they can be connected to the entrances and exits of the duct section 51 (that extend at right angles to one another) as well as to the first duct branching piece 501 and the second duct branching piece 504.

Alternatively, the secondary liquid circuit can also be routed separately and independently from the primary circuit of the liquid metal target. This approach may be useful notably when a cooling liquid that has, for example, a particularly low viscosity and/or a high thermal conductivity is to be used.

In any case, the dissipation of heat that is achieved by means of the duct section 51 in accordance with the invention, that is, the dissipation of heat from the window which is traversed by the electron beam so as to generate X-rays, is significantly more effective than in known devices of this kind, so that the operating temperature can be reduced or the radiation intensity can be increased in a relevant X-ray source.

What is claimed is:

1. An X-ray source that includes a liquid metal target and an electron source for the emission of an electron beam in a window of a duct section wherethrough the liquid metal target flows in the operating condition, characterized in that the duct section (51) is formed by a first duct segment (10, 20) that includes the window (23) and wherethrough the liquid metal target flows, as well as by a second duct segment (30, 40) wherethrough a cooling medium flows and which is connected to the first duct segment in such a manner that the area in which the electron beam acts on the first duct segment is cooled.

2. An X-ray source as claimed in claim 1, characterized in that the first and the second duct segment (10, 20; 30, 40) are situated in a plane that extends essentially perpendicularly to the direction of incidence of the electron beam and enclose an angle of approximately 90 degrees relative to one another.

3. An X-ray source as claimed in claim 1, characterized in that the window in the first duct segment (10, 20) is formed by a first, essentially rectangular slit (23) that is provided with a diamond layer, the longitudinal direction of said slit extending essentially perpendicularly to the direction of flow of the liquid metal target.

4. An X-ray source as claimed in claim 1, characterized in that the first duct segment (10, 20) is provided with a duct (11) in which the liquid metal target flows and which is provided with a constriction at the area of the first slit (23).

5. An X-ray source as claimed in claim 1, characterized in that the second duct segment (30, 40) is arranged between the electron source (3) and the first duct segment (10, 20) and is provided with a second, essentially rectangular slit **(34*a*, 34*b*) wherethrough the electron beam is incident in the first slit (23) of the first duct segment (10, 20)**.

6. An X-ray source as claimed in claim 5, characterized in that the second duct segment (30, 40) includes two ducts (31, 32) for the cooling medium that extend essentially in parallel but diverge at the area of the second slit **(34*a*) in such a manner that they enclose a surface area (35)** that is shaped essentially as a segment of circle in which the second slit is situated.

7. An X-ray source as claimed in claim 5, characterized in that an opening **(34*b*) of the second slit (34*a*) is situated in a recess (43) in the external surface that is provided in the second duct segment (30, 40)** and is shaped essentially as a segment of circle.

8. An X-ray source as claimed in claim 1, characterized in that the first and the second duct segment (10, 20; 30, 40) are connected to a common circuit for the liquid metal target, the liquid metal in the second duct segment acting as the cooling medium.

9. An X-ray apparatus that includes an X-ray source as claimed in claim 1.

* * * * *